US006212348B1

(12) United States Patent
Inoue et al.

(10) Patent No.: US 6,212,348 B1
(45) Date of Patent: Apr. 3, 2001

(54) DEVELOPING UNIT HAVING ELASTIC BLADE

(75) Inventors: Atsushi Inoue; Hiroshi Tatsumi, both of Nara; Takayuki Yamanaka, Tenri; Takashi Sakai, Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/392,444

(22) Filed: Sep. 9, 1999

(30) Foreign Application Priority Data

Sep. 29, 1998 (JP) ..... 10-274692

(51) Int. Cl.[7] ..... G03G 15/08
(52) U.S. Cl. ..... 399/284
(58) Field of Search ..... 399/274, 284, 399/260, 273, 283

(56) References Cited

U.S. PATENT DOCUMENTS 4,337,724 * 7/1982 Hosono et al. ..... 399/103
4,523,833 * 6/1985 Jones ..... 399/272
4,528,936 * 7/1985 Shimazaki et al. ..... 399/284
4,553,829 * 11/1985 Bares ..... 399/274
4,561,381 * 12/1985 Kaneko et al. ..... 399/270
4,566,776 * 1/1986 Kondoh ..... 399/274
4,592,653 * 6/1986 Ikeda et al. .

FOREIGN PATENT DOCUMENTS 58-021278 * 2/1983 (JP) .
61-156168 * 7/1986 (JP) .
6-93152 5/1987 (JP) .
62-182780 11/1987 (JP) .
63-16736 4/1988 (JP) .
4-73152 11/1988 (JP) .
8-076585 3/1996 (JP) .

* cited by examiner

*Primary Examiner*—Robert Beatty

(57) ABSTRACT

A developing unit having an elastic blade which is provided with rectangular holes along the width in the area between its abutment portion against a developing roller and the supported end.

16 Claims, 8 Drawing Sheets

DEVELOPING UNIT HAVING ELASTIC BLADE

BACKGROUND OF THE INVENTION

1. Field of the Invention

The present invention relates to a developing unit applicable to machines such as copiers, printers, facsimile machines which perform image forming by electrophotography. More particularly the present invention relates to a developing unit which regulates the developer supplied on the developer support so as to form a developer layer of a predetermined thickness having a specified amount of static charge by means of a flexible plate-like developer layer regulating member and conveys the developer layer to a static latent image to develop it into a visual image.

2. Description of the Related Art

Conventionally, a two-component developing unit using a so-called two-component developer consisting of a toner and a magnetic carrier is disadvantageously complex, large-sized and expensive because it needs a toner concentration regulating device to keep the mixing ratio of the toner to the magnetic carrier constant. On the other hand, a mono-component developing unit using a so-called mono-component developer consisting of only a toner with no magnetic carrier advantageously has a simple structure and hence can be made compact and also offers cost and maintenance benefits.

Mono-component developing units can be roughly classified into two types, that is, the magnetic mono-component developing unit using a mixture of resin and magnetic iron powder or using a magnetic toner of resin having magnetic iron particles as cores, and the non-magnetic mono-component developing unit using a non-magnetic toner composed of resin and pigments with no magnetic material.

Two systems have been known as the magnetic mono-component developing units: the first is the non-contact developing system in which development is performed by conveying the magnetic toner by means of a non-magnetic developing sleeve having a magnet roller therein while an alternating electric field is applied across the space between the developing sleeve and the photosensitive drum set with a predetermined gap therebetween so as to cause the toner to jump in a reciprocating manner; and the second is the contact developing system in which development is performed by forming a large toner brush so as to come into contact with the static latent image on the photosensitive drum surface. The former needs a developing bias of a d.c. voltage with a superimposed a.c. voltage, and hence requires a complicated power source and that the developing unit be resistant to high voltage. On the other hand, the latter can make do with only a simple d.c. developing bias power source but produces a Hi-gamma (γ) image with poor gradation.

There are two systems for the non-magnetic mono-component developing units: the first is the non-contact developing system in which development is performed by applying an alternating electric field across the space between the developing roller and the photosensitive drum set with a predetermined gap therebetween so as to cause the toner to jump in a reciprocating manner; and the second is the contact developing system in which development is performed by bringing the conductive elastic developing roller into contact with the photosensitive drum. The former needs a developing bias of a d.c. voltage with a superimposed a.c. voltage, and hence requires a complicated power source and that the developing unit be resistant to high voltage. On the other hand, the latter needs only a simple d.c. developing bias power source. Since non-magnetic mono-component developing units using a toner having no magnetic material and do not use any magnet roller, they offer the advantage of providing a compact and inexpensive color developing unit which produces clear colors.

For all the mono-component developing units, it is necessary to form a tribo-charged developer (toner) layer having a predetermined layer thickness on the developing roller or developing sleeve.

As the method for forming a developer (toner) layer on the developing roller, Japanese Patent Publication Sho 63 No.16736 and Japanese Patent Publication Hei 4 No.73152 disclose devices having an elastic regulating plate or a plate-like flexible tribo-charging element. Japanese Patent Application Laid-Open Sho 62 No.182780 disclose a developer layer regulating member which has a metal sheet having spring properties and a soft elastic part integrated with this metal sheet and located between the metal sheet and the developer support.

In order to form a uniform developer layer over a long period, Japanese Patent Publication Hei 6 No.93152 limits the ratio of the free length to the thickness of the leaf spring of a developer regulating member.

Typically, a plate-like developer layer regulating member having flexibility (hereinbelow referred to as 'elastic blade') can be modeled as a cantilever 335 supported at a fixed supporter 355 as shown in FIG. 1. The relationship between an abutment load P(kgf) acting on cantilever 335 shown in FIG. 1 at its free end and its deflection amount δ(mm) is represented by the following formula (1):

$$P=(3EI/L^3)\delta \tag{1}$$

where

E: elastic modulus(kgf/mm$^2$)

I: geometrical moment of inertia(mm$^4$)

L: cantilever free length (mm)

From the above formula (1), it is understood that the abutment load P at the free end is proportional to the free end deflection amount δ and is inversely proportional to the cube of the cantilever free length L when the material and the cross-section shape of the cantilever are constant (EI= constant).

In designing an elastic blade, the material, free length L, plate thickness t and free end deflection amount δ are determined based on the abutment load P at the free end, required for the toner layer to be properly formed on the developing roller. Here, since the free end deflection amount δ of the elastic blade is determined by the attachment position of the elastic blade with respect to the developing roller, the positional attachment error of the elastic blade will appear as the error of the free end deflection amount δ and hence as an error of the abutment load P at the free end.

Further, eccentricity, run-out of the developing roller, etc. will cause variation in the abutment load P at the free end. Wear at the developing roller bearing and thermal expansion and contraction of the supporter member for the developing roller and the elastic blade, that is, the developing unit casing, also will cause the abutment load P at the free end to vary with the passage of time (lapse of time) and also dependent on the environmental conditions.

The margin of the positional attachment error or the installation tolerance of the elastic blade can be enlarged by reducing (3EI/L$^3$), the constant of proportionality between the free end deflection amount δ of the elastic blade and abutment load P at the free end. In general, the free length L of the elastic blade is determined by the size and configuration of the developing unit so that it is difficult to make it greater than the developing unit needs. Further, in order to make the developing unit compact, the free length L inevitably shortens, which further increases the constant of proportionality ($3EI/L^3$), Since elastic coefficient E is a characteristic value of the material of the elastic blade, the choice is limited. Therefore, in order to make the constant of proportionality, ($3EI/L^3$) small, it is more realistic to reduce the value of the geometrical moment of inertia I.

Meanwhile, the fundamental circular frequencies $\omega_n$ of cantilever 335 shown in FIG. 1 are represented by the following formula (2):

$$\left.\begin{aligned}\omega_1 &= (1.875/L)^2\sqrt{EI/\gamma A}\\ \omega_2 &= (4.694/L)^2\sqrt{EI/\gamma A}\end{aligned}\right\} \quad (2)$$

γ: mass per unit volume ($kg/mm^3$)

A: cross section of the cantilever ($mm^2$)

From the above formula (2), it is understood that the fundamental circular frequencies $\omega_n$ of cantilever 335 are proportional to the square root of the geometrical moment of inertia I when the material and the free length of the cantilever are constant.

When the elastic blade receives vibrations at its free end due to the eccentricity, and/or run-out and the rotation of the developing roller or due to stick-slip caused by variations of its frictional resistance with the developing roller, the elastic blade may resonate and exert adverse influence on toner layer formation.

In order to avoid the elastic blade from resonating at its fundamental circular frequencies $\omega_n$, it is preferable to control the geometric moment of inertia I since the flexibility in selection of the free length L and the elastic coefficient E is limited as stated above.

The geometrical moment of inertia I is given by formula (3):

$$I=Ht^3/12 \quad (3)$$

where t(mm) is the plate thickness of the elastic blade, H(mm) is the full width.

In the above formula (3), the full width H of the elastic blade is determined as a constant value depending upon the developer layer forming width. Therefore, in order to reduce the geometrical moment of inertia I, it is necessary to make the plate thickness t of the elastic blade small. However, there is a limitation from the viewpoint of the manufacturing process of the blade or from a handling viewpoint. That is, it is necessary to make the geometrical moment of inertia I small without reducing the plate thickness t of the elastic blade more than necessary.

However, with regard to conventional elastic blades, the geometrical moment of inertia I can be changed by only the plate thickness t. Therefore, there has been little design flexibility to increase the margin for the abutment load, also, taking into consideration the variations of the passage of time and change with environmental conditions and to select the fundamental circular frequencies at which the toner layer formation failure due to resonance can be inhibited.

SUMMARY OF THE INVENTION

The present invention has been devised from the above viewpoint, it is therefore an object of the present invention to provide a developing unit having an elastic blade which enables enlargement of the assembly tolerance of the elastic blade relative to the developing roller, stabilization of the elastic blade abutment load with the passage of time and with change of the environmental conditions, and improvement of the flexibility in selecting the fundamental circular frequencies and is suitable for downsizing of the developing unit.

In order to achieve the above object, the present invention is configured as follows:

In accordance with the first aspect of the invention, a developing unit includes:

a developer support for retaining and conveying the developer; and a flexible plate-like developer layer regulating member which is supported and fixed at one end and is free at the other end and abuts a flat portion of itself in proximity to its free end against the developer support so as to form a developer layer of a designated thickness on the developer support, and is characterized in that void space made up of at least one through-hole and/or recess is formed along the width in the area between the abutment portion of the developer layer regulating member abutting on the developer support and the fixed supported end.

In accordance with the second aspect of the invention, a developing unit includes:

a developer support for retaining and conveying the developer; and a flexible plate-like developer layer regulating member which is supported and fixed at one end and is free at the other end and abuts a flat portion of itself in proximity to its free end against the developer support so as to form a developer layer of a designated thickness on the developer support, and is characterized in that a plurality of void spaces made up of through-holes and/or recesses are formed along the width in the area between the abutment portion of the developer layer regulating member abutting on the developer support and the fixed supported end, and the plurality of void spaces are formed of the same void space shape at regular intervals, on the area of the developer layer regulating member corresponding to at least, the middle, the developer layer forming area on the developer support.

In accordance with the third aspect of the invention, the developing unit having the above second feature is characterized in that the void space ratio (Lh/P) is set at 0.5 or lower, where Lh is the maximum dimension along the width of the void space formed in the developer layer regulating member and P is the pitch between a void space and adjacent void space.

In accordance with the fourth aspect of the invention, the developing unit having the above second or third aspect is characterized in that the void space ratio at both the end areas of the developer layer regulating member is set smaller than that in the middle portion.

In accordance with the fifth aspect of the invention, the developing unit having the above first, second or third aspect is characterized in that the ratio (Lh/Lv) is set at 1 or lower, where Lh is the maximum dimension along the width of the void space formed in the developer layer regulating member and Lv is the maximum dimension in the direction perpendicular to the width of the void space.

In accordance with the sixth aspect of the invention, the developing unit having the above fourth aspect is characterized in that the ratio (Lh/Lv) is set at 1 or lower, where Lh is the maximum dimension along the width of the void space formed in the developer layer regulating member and Lv is the maximum dimension in the direction perpendicular to the width of the void space.

In accordance with the seventh aspect of the invention, the developing unit having the above first aspect is characterized in that multiple series of void spaces are formed along the width of the developer layer regulating member.

In accordance with the eighth aspect of the invention, the developing unit having the above first, second, third, sixth or seventh feature is characterized in that the at least one void space is formed in an area closer to the fixed supported end with respect to the mid point between the free end and the fixed supported end of the developer layer regulating member.

In accordance with the ninth aspect of the invention, the developing unit having the above fourth aspect is characterized in that the at least one void space is formed in an area closer to the fixed supported end with respect to the mid point between the free end and the fixed supported end of the developer layer regulating member.

In accordance with the tenth aspect of the invention, the developing unit having the above fifth aspect is characterized in that the at least one void space is formed in an area closer to the fixed supported end with respect to the mid point between the free end and the fixed supported end of the developer layer regulating member.

In accordance with the eleventh aspect of the invention, the developing unit having the above first, second, third, sixth, seventh, ninth or tenth aspect is characterized in that a sealing element having a higher flexibility than the developer layer regulating member is provided on at least one side in the through-hole formed area of the developer layer regulating member.

In accordance with the twelfth aspect of the invention, the developing unit having the above fourth aspect is characterized in that a sealing element having a higher flexibility than the developer layer regulating member is provided on at least one side in the through-hole formed area of the developer layer regulating member.

In accordance with the thirteenth aspect of the invention, the developing unit having the above fifth aspect is characterized in that a sealing element having a higher flexibility than the developer layer regulating member is provided on at least one side in the through-hole formed area of the developer layer regulating member.

In accordance with the fourteenth aspect of the invention, the developing unit having the above eighth aspect is characterized in that a sealing element having a higher flexibility than the developer layer regulating member is provided on at least one side in the through-hole formed area of the developer layer regulating member.

In accordance with the fifteenth aspect of the invention, the developing unit having the above eleventh aspect is characterized in that a sealing element having a higher flexibility than the developer layer regulating member is provided on at least one side in the through-hole formed area of the developer layer regulating member.

In accordance with the sixteenth aspect of the invention, the developing unit having the above first or second aspect is characterized in that the developer layer regulating member comprises an elastic metal plate.

In accordance with the seventeenth aspect of the invention, the developing unit having the above first or second aspect is characterized in that the developer support comprises a conductive elastic roller.

In accordance with the eighteenth aspect of the invention, the developing unit having the above first or second aspect is characterized in that the developer is of a non-magnetic mono-component developer.

According to the first aspect of the invention, since at least one void space is formed along the width in the area between the abutment portion of the developer layer regulating member on the developer support and the fixed supported end of the developer layer regulating member, it is possible to reduce the geometrical moment of inertia and lessen the variational gradient of the linear load at the abutment portion (abutment load at the free end) with respect to the displacement (bending) of the front end of the developer layer regulating member, leading to enlargement of the assembly tolerance. Further, since the characteristic frequency of the developer layer regulating member can be selected freely, it is possible to prevent a bad formation of the developer layer due to vibration (resonance) of the developer layer regulating member, which leads to a clear reproduction of image.

According to the second aspect of the invention, since the plurality of void spaces are formed of the same opening shape at regular intervals, along the width of the developer layer regulating member, at least, in the middle portion, the linear load in the mid portion of the developer regulating member for forming a developer layer can be set up freely, independent of the sheet thickness and the free length of the developer layer regulating member. Therefore, it is possible to form a desired developer layer corresponding to the image area.

According to the third aspect of the invention, since the void space ratio (Lh/P) is set at 0.5 or lower, where Lh is the maximum dimension along the width of the void space formed in the developer layer regulating member and P is the pitch between a void space and its adjacent void space, it is possible to prevent pressing failure at the sites extending to the free end from the areas of the void spaces in the developer layer regulating member, thus enabling stabilized developer layer formation.

According to the fourth aspect of the invention, since the void space ratio at both the end areas (along the width) of the developer layer regulating member is set smaller than that in the middle portion, it is possible to avoid toner leakage from both end areas of the developer support while the linear load at both the end areas of the developer layer regulating member will not become too small.

According to the fifth and sixth aspects of the invention, since the ratio (Lh/Lv) is set at 1 or lower, where Lh is the maximum dimension along the width of the void space formed in the developer layer regulating member and Lv is the maximum dimension in the direction perpendicular to the width of the void space, it is possible to enhance the flexibility of the developer layer regulating member, which enables downsizing of the developing unit.

According to the seventh aspect of the invention, since multiple series of void space are formed along the width of the developer layer regulating member, the flexibility of the developer layer regulating member can be enhanced by combinations of multiple series of through-hole of a simple shape such as a circle or combination of multiple series of recess, which enables downsizing of the developing unit as well as stabilized developer layer formation.

According to the eighth through tenth aspects of the invention, since at least one void space is formed in an area closer to the fixed supported end with respect to the mid point between the free end and the fixed supported end of the developer layer regulating member, it is possible to eliminate the possibility of the openings exerting influence on the free end of the developer layer regulating member and hence it is possible to form a more stabilized developer layer.

According to the eleventh through fifteenth aspects of the invention, since a sealing element having a higher flexibility than the developer layer regulating member is provided on at least one side in the through-hole formed area of the developer layer regulating member, it is possible to prevent toner scattering through the holes formed on the developer layer regulating member without degrading the flexibility of the developer layer regulating member.

According to the sixteenth aspect of the invention, since the developer layer regulating member comprises an elastic metal plate, the perforation process for the developer layer regulating member can be simplified, which leads to provision of a low cost developer layer regulating member.

According to the seventeenth aspect of the invention, since the developer support comprises a conductive elastic roller, there is no need for a complex developing bias power source and hence it is possible to realize a compact inexpensive developing unit using, for example, a d.c. developing bias with no a.c. voltage superimposed.

According to the eighteenth aspect of the invention, since the developer is of a non-magnetic mono-component developer, it is possible to realize a compact developing unit capable of producing an excellent color image.

DESCRIPTION OF THE PREFERRED EMBODIMENTS

The embodiments of the invention will hereinafter be described in detail with reference to the accompanying drawings.

Figure 1:
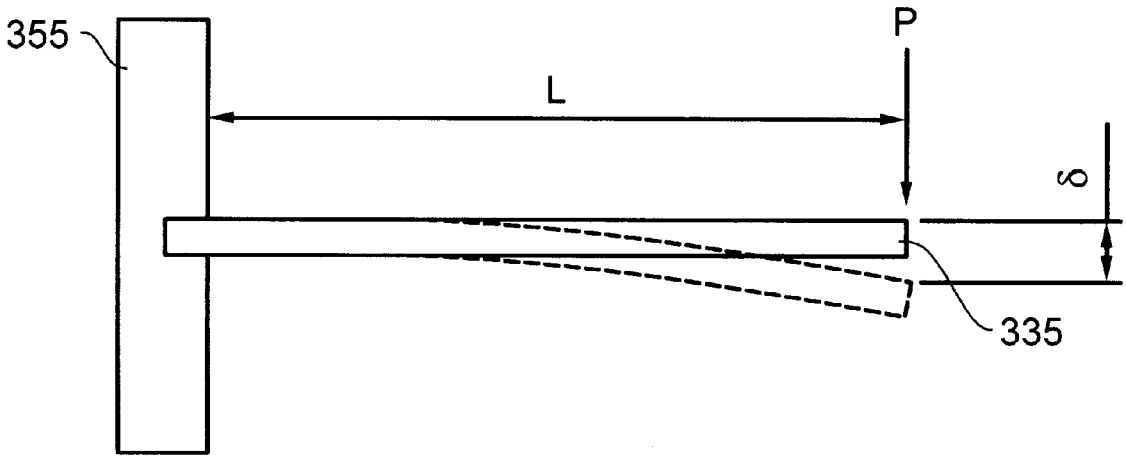
FIG. 1 is an illustration showing a cantilever.
Figure 2:
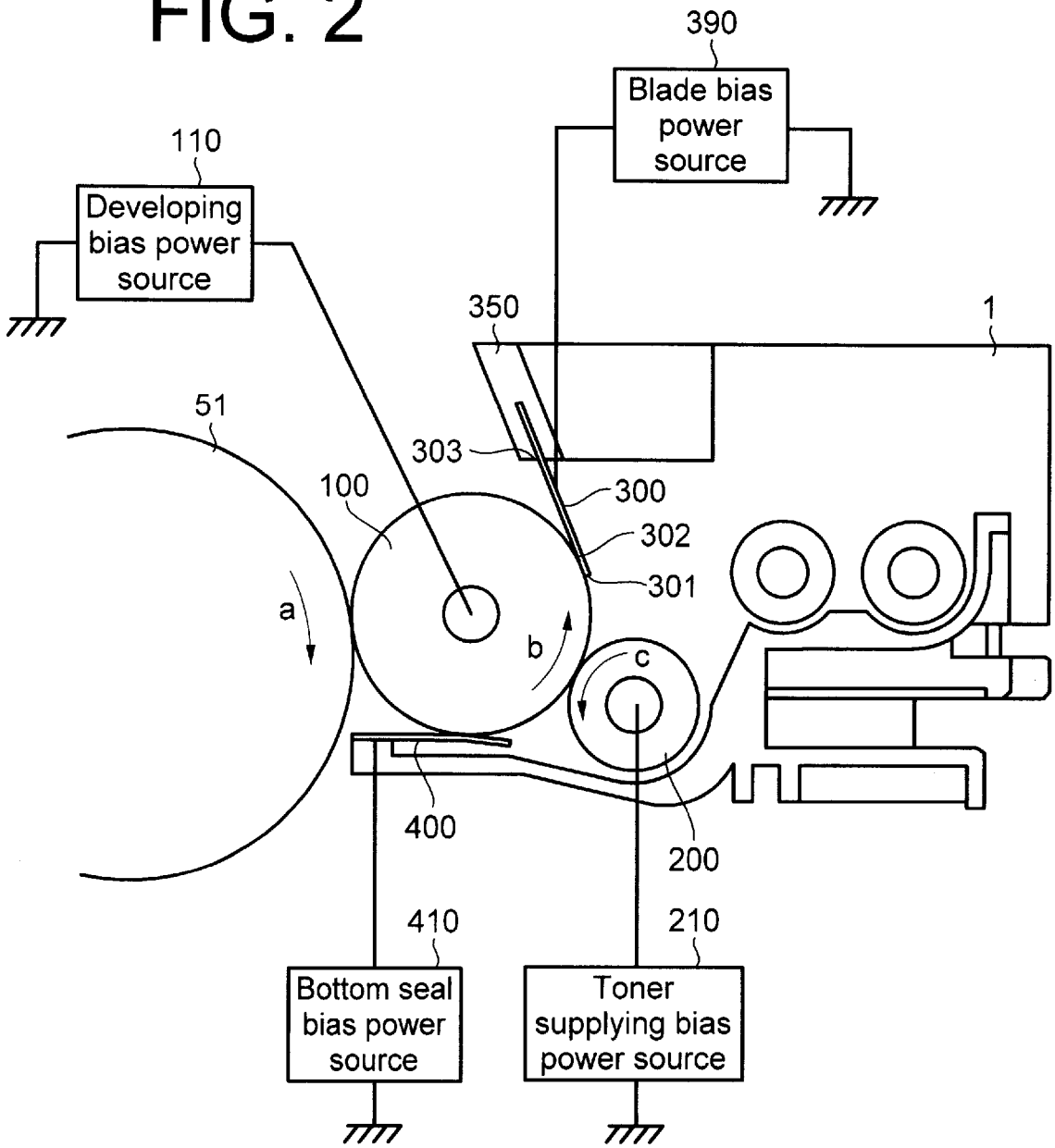
FIG. 2 is a schematic sectional view showing an electrophotographic developing unit using an elastic blade 300 in accordance with an embodiment of the invention.

FIG. 2 is a schematic sectional view showing an electrophotographic developing unit using an elastic blade of the invention. In FIG. 2, a negatively chargeable photosensitive drum 51 is 65 (mm) in diameter and rotates at a peripheral speed of 190 (mm/s) in the direction of arrow a with the conductive substrate grounded and the surface potential charged at −550(V). Arranged opposing this photosensitive drum 51 is a developing roller 100 supported by a casing 1 of the mono-component developing unit.

Developing roller 100 is a conductive elastic roller with a diameter of 34 (mm) formed of a conductive urethane rubber having a conductionizing agent such as carbon black and the like added, and has a volume resistivity of about $10^6$ (Ωcm) and a JIS-A hardness of 60 to 70 degrees with a surface roughness Rz of 3 to 6 (μm) conforming to JISB-0601.

Developing roller 100 is in contact with photosensitive drum 51 with a contact depth of 0.1 to 0.3 (mm) with a toner layer in between and rotates at a peripheral speed of 285 (mm/s) in the direction of arrow b while having a developing bias voltage of −450(V) applied from a developing bias power source 110 via a stainless shaft having a diameter of 18 (mm).

A toner supplying roller 200 performs both agitation, at the vicinity of bottom, of the toner stored in box-like casing 1 and removal of the toner remaining on the surface of developing roller 100 after development. This roller is a conductive elastic foam roller having a diameter of 20 (mm), a volume resistivity of about $10^5$ (Ωcm), a cellular density of 80 to 140 (cells/inch) and a hardness ranging from 60 degrees on Asker F basis to 30 degrees on Asker C basis.

Here, the hardness on Asker C basis is the measurement, conforming to JIS S 6050, obtained by a spring type hardness tester. Compared to an Asker C durometer, the hardness on Asker F basis is the measurement obtained by a durometer having a cylindrical indenter having a diameter of 25.2 (mm) with a spring load of 55 g to 455 g (corresponding to the range from 0 to 100 degrees) where the pressed surface is a circle having a diameter of 80 mm. Both the measurements were measured by using durometers of KOBUNSHI KEIKI Co., LTD.

Toner supplying roller 200 is in contact with developing roller 100 with a contact depth of 0.5 to 1 (mm) and rotates at a peripheral speed of 170 (mm/s) in the direction of arrow c while having a toner supplying bias voltage of −550(V) applied from a toner supplying bias power source 210 via a stainless shaft having a diameter of 8 (mm).

Elastic blade 300 is a flexible stainless sheet having a thickness of 0.1 to 0.2 (mm) and has a cantilever structure having a free end 301 on the upstream side with respect to the rotational direction of developing roller 100.

Elastic blade 300 is gripped at its supported end 303 (opposite to free end 301) by a blade holder 350 while a flat portion 302 in proximity to free end 301 abuts the developing roller 100 surface with a linear load of 10 to 50 (gf/cm). This elastic blade has a blade bias voltage of −550(V) applied from a blade bias power source 390.

A bottom seal 400 is to prevent the toner from leaking and is made of a Mylar film of 0.2 to 0.4 (mm) thick.

Bottom seal 400 may be made conductive as necessary by using an aluminum deposition film etc. with its conductive surface abutted on the developing roller 100 so as to apply the same voltage as or a voltage higher by about 50(V) or more than, that of developing roller 100 from a bottom seal bias power source 410, to produce charge erasure effects on the toner.

In the arrangement thus configured, the layer of the non-magnetic mono-component toner, which has been negatively pre-charged by toner supplying roller 200 and applied on the surface of developing roller 100, is regulated by elastic blade 300 so as to have an adhered toner amount of 0.6 to 1.0 (mg/cm$^2$) with a static charge amount of −10 to −15 (μC/g) for contact reversal development.

In connection with this, because of the effective roller resistance r of the developing roller and the development current i flowing during development, a voltage drop of $Vd=i\times r$ will occur inside the developing roller. Therefore, it is possible to lower the effective developing bias applied to the developing roller surface, by adjusting the effective roller resistance appropriately, so that the development characteristics of harsh two tones can be modified into a desired graduation of tones.

Next, elastic blade 300 shown in FIG. 2 will be described in detail with reference to the drawings.

Figure 3:
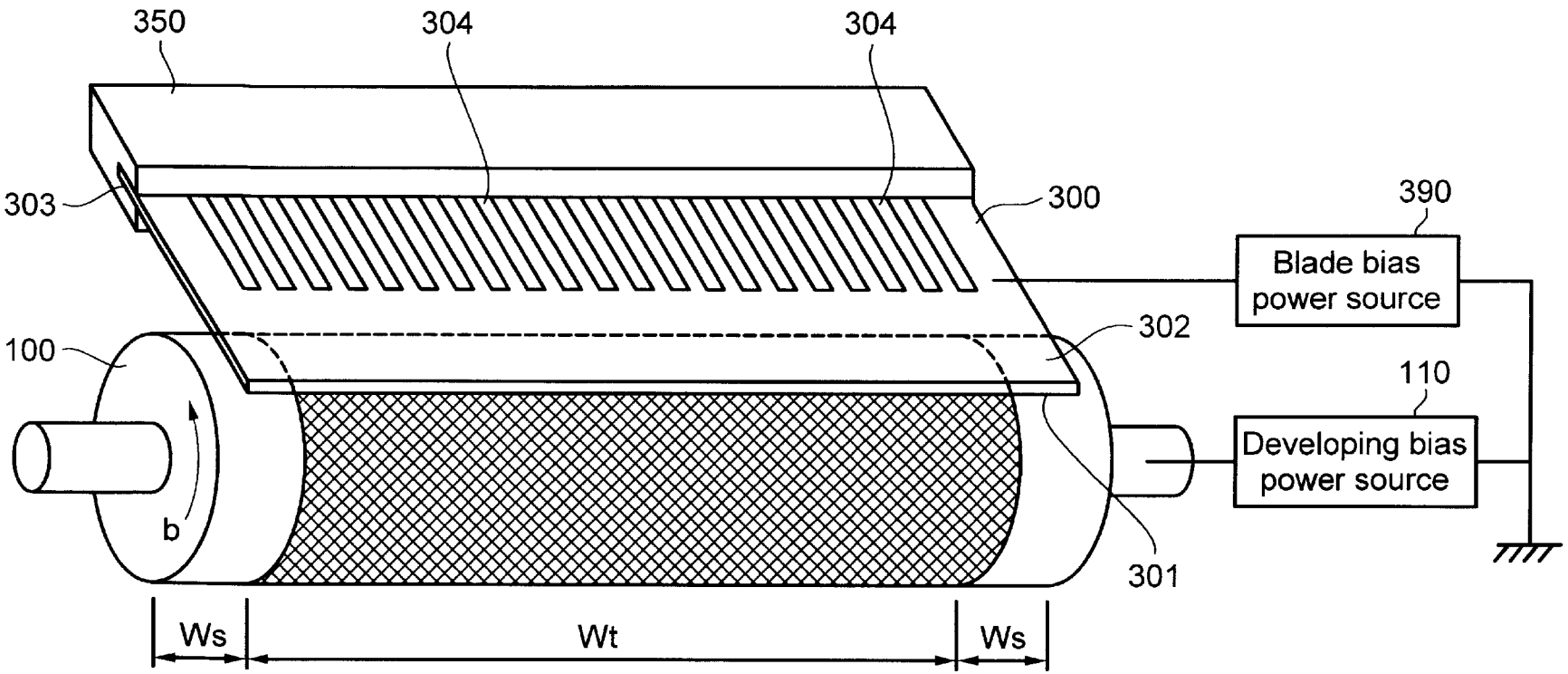
FIG. 3 is a perspective view showing the usage state of an elastic blade 300 in accordance with an embodiment of the invention.

FIG. 3 is a perspective view showing the usage state of elastic blade 300, wherein elastic blade 300 held at supported end 303 by blade holder 350 is put, along its width, in line contact with developing roller 100. In the figure, Wt in developing roller 100 designates a developer layer forming area where the toner layer is formed, and Ws designates non-developer layer forming areas where no toner layer is formed. Here, the same components as in FIG. 2 are allotted with the same reference numerals while rectangular holes 304 will be described later.

Figure 4:
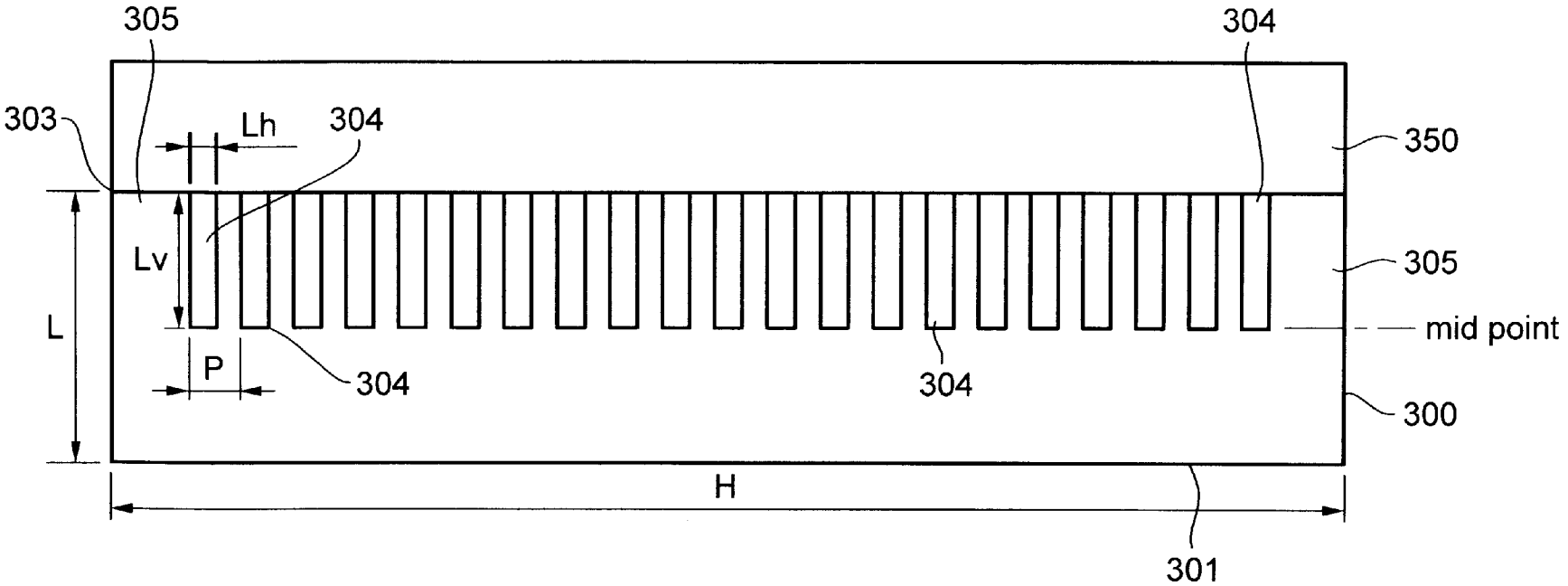
FIGS. 4 and 4A are a front views showing elastic blade 300 in accordance with embodiments of the invention.

FIG. 4 is a schematic front view showing elastic blade 300 in FIG. 3.

In FIG. 4, elastic blade 300 is 320 (mm) in its full width H and 18 (mm) in its free length L, wherein a series of rectangular holes 304 of the same shape are formed at regular intervals along the blade's longitudinal direction (the width) in the area corresponding to developer layer forming area Wt on developing roller 100. For each rectangular hole 304, Lh=2 (mm) and Lv=9 (mm), where Lh is the size in width (in the blade's longitudinal direction) and Lv is the size in the direction perpendicular to the width (the blade's longitudinal direction). The distance between the neighboring rectangular holes 304 is 2 (mm). Therefore, rectangular holes 304 are arranged so that the pitch P, or the distance from the left edge (in the drawing) of one hole 304 to the left edge of the next hole 304, is 4 mm. The end areas 305 of elastic blade 300 are provided as margins of 10 (mm) where no rectangular holes 304 are formed.

The locations of rectangular holes 304 are not limited but in this embodiment they are positioned more closer to the supported end 303 with respect to the middle of free end 301 and supported end 303.

The longitudinal direction of elastic blade 300 is defined as the width or the direction of linear abutment of elastic blade 300 on developing roller 100 (see FIG. 3).

Reference numeral 350 designates the blade holder already mentioned.

FIG. 5 is a schematic front view showing variational elastic blades.

Figure 5A:
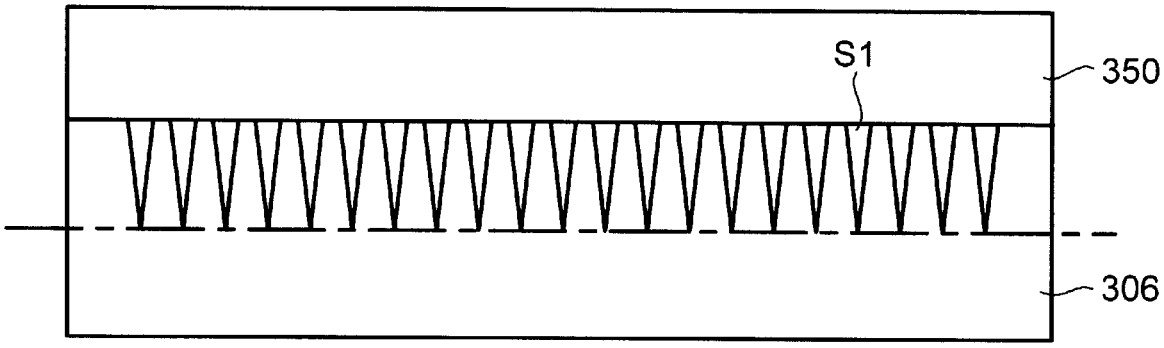
FIGS. 5A to 5C are front views showing elastic blades in accordance with variational embodiments of the invention.
Figure 5B:
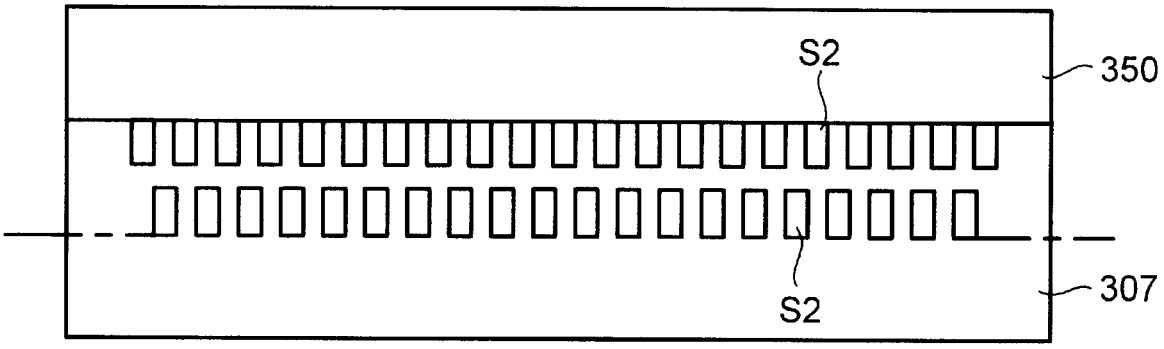
Figure 5C:
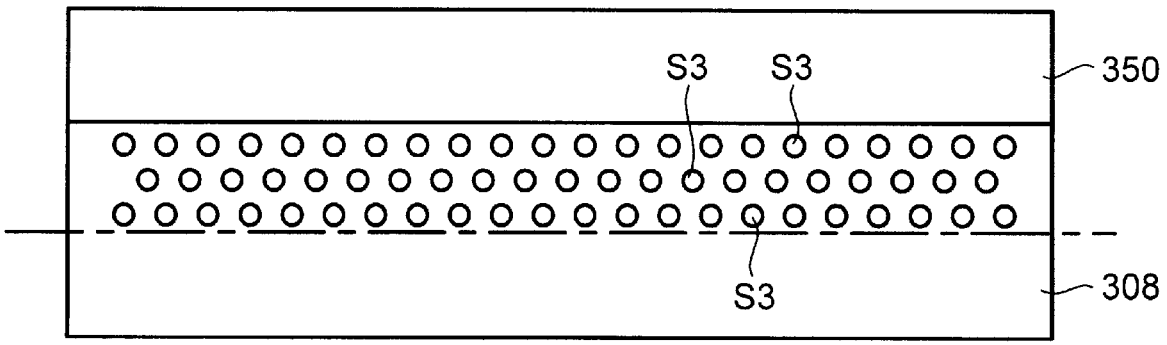

The holes formed in the elastic blade may be of a triangular shape S1 as shown in FIG. 5A. Alternatively, multiple series of holes of a rectangular shape S2 shown in FIG. 5B or of a circular shape S3 shown in FIG. 5C may be formed. Further, multiple series of different types of holes may be formed in combination. In each case, holes S1, S2 or S3 are located closer to blade holder 350 of each elastic blade 306, 307 or 308.

As has been described, since perforations such as rectangular holes 304, holes S1, etc., are formed along the width in the area between the abutment portion 302 of elastic blade 300 in contact with developing roller 100 and supported end 303, it is possible to reduce the geometrical moment of inertia, and hence it is possible to reduce the variational gradient of the linear load (free end abutment load) at abutment portion 302 (FIGS. 2 and 3) with respect to the displacement (deflection δ) of free end 301 of elastic blade 300. As a result, it is possible to take a greater initial setup tolerance of the attachment position of the elastic blade relative to developing roller 100 (FIGS. 2 and 3) and to form a more stable toner layer with the passage of time and with change of environmental conditions, leading to an image free from density unevenness. Further, it is possible to set the characteristic frequency at a desired value, hence it is possible to avoid toner layer formation failure due to the vibration (resonance) of elastic blade 300, leading to a clear reproduction of image.

In the invention, multiple holes of a desired shape, such as rectangular holes 304, holes S1, S2 and S3, can be formed of the same opening shape at intervals of a desired distance, along the width of elastic blade 300, within at least, the area corresponding to the developer layer forming area Wt. Therefore, a desired linear load of abutment portion 302 acting on developer layer forming area Wt where the developer layer is formed, can be set up independently of the plate thickness and/or the free length of elastic blade 300, thus making it possible to form a desired developer layer corresponding to the image area.

Since no perforations such as rectangular holes 304, holes S1 or the like are formed at end areas 305 of elastic blade 300, the abutment force of elastic blade 300 acting at end areas 305 on developing roller 100 will not become too small. Therefore, it is possible to avoid toner leakage from both end areas 305.

In the invention, setting of the ratio (Lh/P) of the maximum dimension Lh to the pitch P at 0.5 or lower, where Lh (see FIG. 4) is the maximum dimension in the longitudinal direction (the width H) of multiple perforations such as rectangular holes 304, holes S1 or the like, formed in elastic blade 300 and P (see FIG. 4) is the pitch with which the holes are arranged equidistantly, makes it possible to avoid the occurrence of pressing failure at the sites extending to free end 301 from the areas of the perforations such as rectangular holes 304, or holes S in elastic blade 300, thereby enabling stabilized developer layer formation.

Figure 4A:
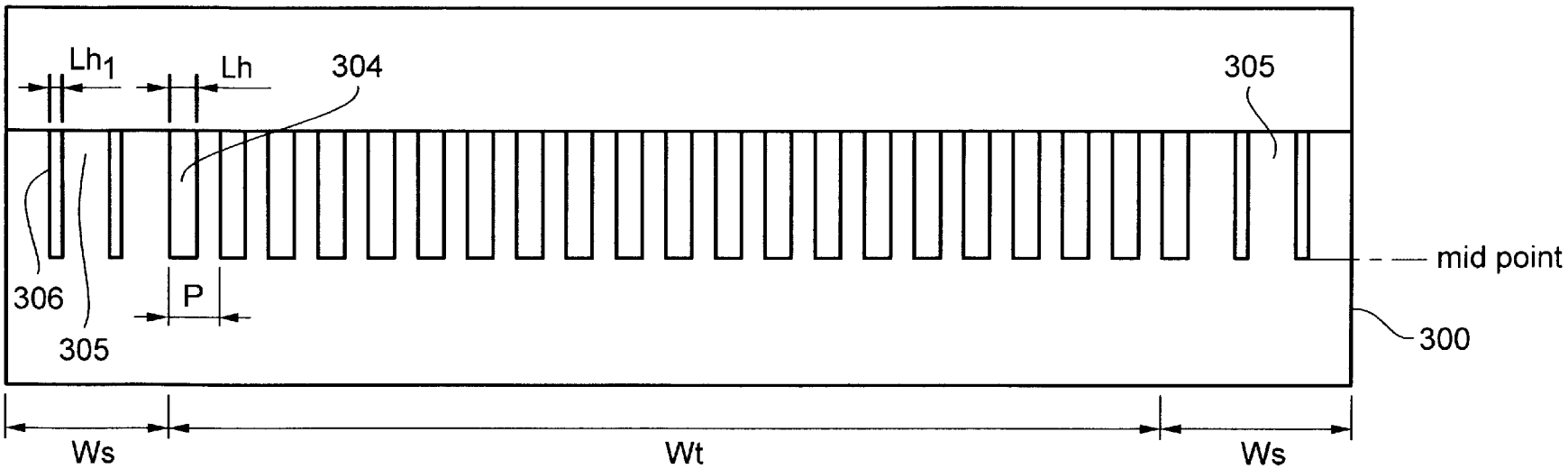

As illustrated in FIG. 4A, when the opening ratio (Lh/P) of perforations such as rectangular holes 304, holes S1 etc., at both end areas 305 of elastic blade 300 is set smaller than the opening ratio in developer layer forming area Wt (see FIG. 3), it is possible to avoid excessive reduction of the linear load of abutment portion 302 at end areas 305 of elastic blade 300 and hence prevent toner leakage from both the end areas of developing roller 100. In the example of FIG. 4A, the dimension $Lh_1$ of rectangular holes 306 in end areas 305 is set smaller than in developer layer forming area Wt, to provide a comparatively smaller opening ratio. In the alternative, pitch P can be increased in end areas 305, with or without decreasing dimension $Lh_1$ of rectangular holes 306, to provide a smaller opening ratio.

Setting of the ratio (Lh/Lv) of the maximum dimension Lh to the maximum dimension Lv at 1 or lower, where Lh (see FIG. 4) is the maximum dimension in the longitudinal direction (the width H) of perforations such as rectangular holes 304, holes S1 or the like, formed in elastic blade 300 and Lv (see FIG. 4) is the maximum dimension in the direction perpendicular to the width, makes it possible to enhance the flexibility of elastic blade 300 and hence make the developing unit compact.

Formation of multiple series of holes S3 or the like along the width H (see FIG. 4) of elastic blade 300 enables combinations of simple shapes such as circles etc., in rows to enhance the flexibility of elastic blade 300 and hence make the developing unit compact whilst producing a desired stable developer layer.

Formation of perforations such as rectangular holes 304, holes S or the like in an area closer to supported end 303 with respect to the middle (the mid point of the direction perpendicular to the width of elastic blade 300) of free end 301 and supported end 303 of elastic blade 300, eliminates the risk of rectangular holes 304, holes S1 or the like exerting influence on free end 301 of elastic blade 300 and hence enables more stabilized developer layer formation.

Since elastic blade 300 is made up of an elastic metal sheet, e.g., a flexible stainless sheet, the perforation process of holes such as rectangular holes 304, holes S1 or the like can be simplified, leading to provision of an inexpensive elastic blade 300.

In the above embodiment, elastic blade 300 is made up of stainless steel, but it may also use other conductive plate-like materials (of phosphor bronze, conductive resin, or the like).

Since developing roller 100 is a conductive elastic roller, it is possible to eliminate the necessity of a complex developing bias power source and hence realize a compact inexpensive developing unit using a d.c. developing bias with no a.c. voltage superimposed.

Further, since the developer is a non-magnetic mono-component developer, it is possible to realize a compact developing unit capable of producing an excellent color image.

As has been described, in the above embodiments, the provision of perforations such as rectangular holes 304, holes S1, S2 or S3 in elastic blade 300, enables enlargement of the initial setup tolerance of the attachment position of the elastic blade with respect to developing roller 100 and hence makes it possible to form a stable toner layer with the passage of time and with change of the environmental conditions, leading to an image free from density unevenness. However, rectangular holes 304, holes S or the like do not necessarily need to be passage holes (through-holes). Next, configurations which can offer the same effects as above but have no passage hole in elastic blade 300 (FIG. 2) will be described.

Figure 6:
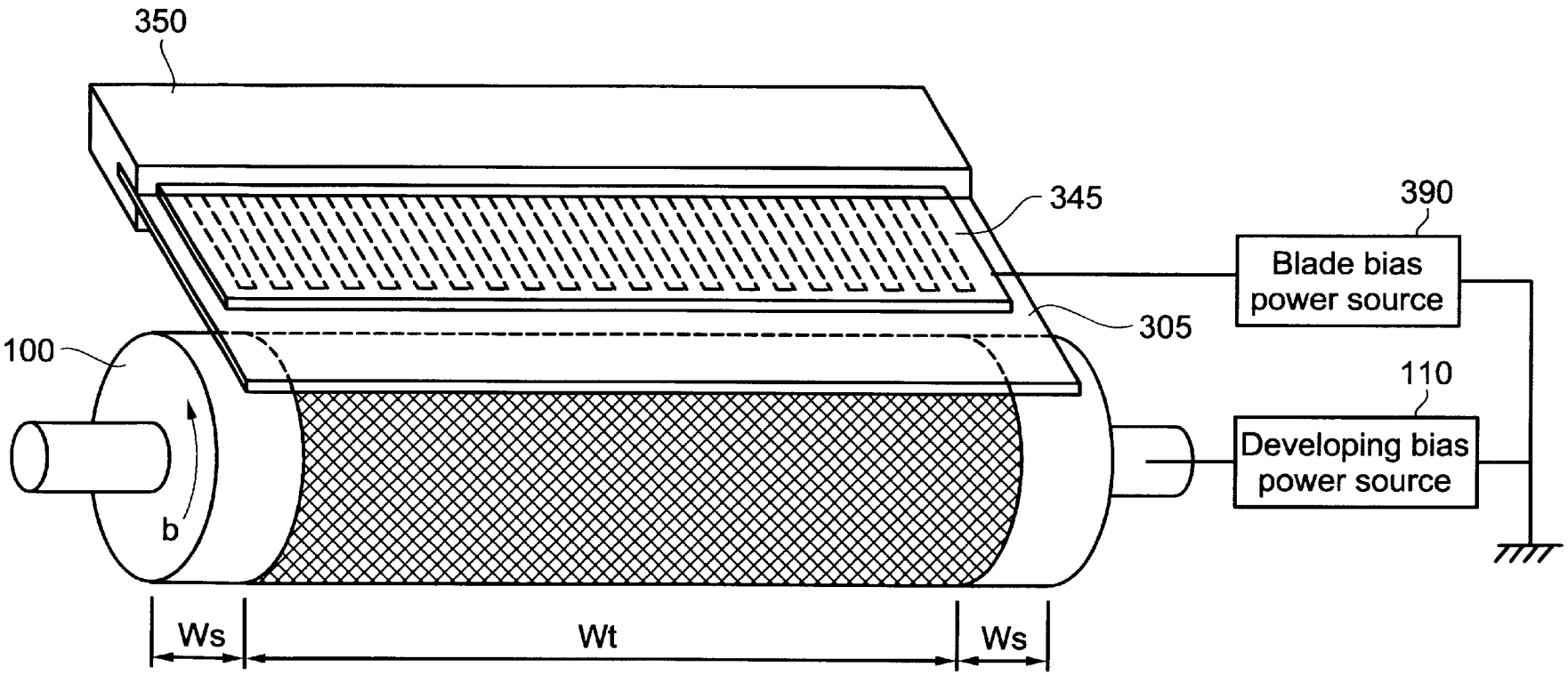
FIG. 6 is a perspective view showing an embodied configuration where a sealing element 345 is attached to an elastic blade 300 of an embodiment of the invention.

FIG. 6 is a perspective view showing an embodiment where a sealing element 345 is applied to elastic blade 300 having a series of rectangular holes 304 on the side opposite to that in contact with developing roller 100 so as to close the rectangular holes 304.

In this case, sealing element 345 needs to use a material that provides a high flexibility so as not to hinder elastic deformation of elastic blade 300. In the present embodiment, adhesive tape of about 50 ($\mu$m) thick was used as sealing element 345. This successfully blocked toner transfer via rectangular holes 304 formed on elastic blade 300, thus preventing toner from making the copier body dirty. In connection with this, the same effects can be obtained when sealing element 345 is attached to the blade on the side in contact with developing roller 100, In FIG. 6, the same components as those in the above configuration are allotted with the same reference numerals and are not described.

Figure 7A:
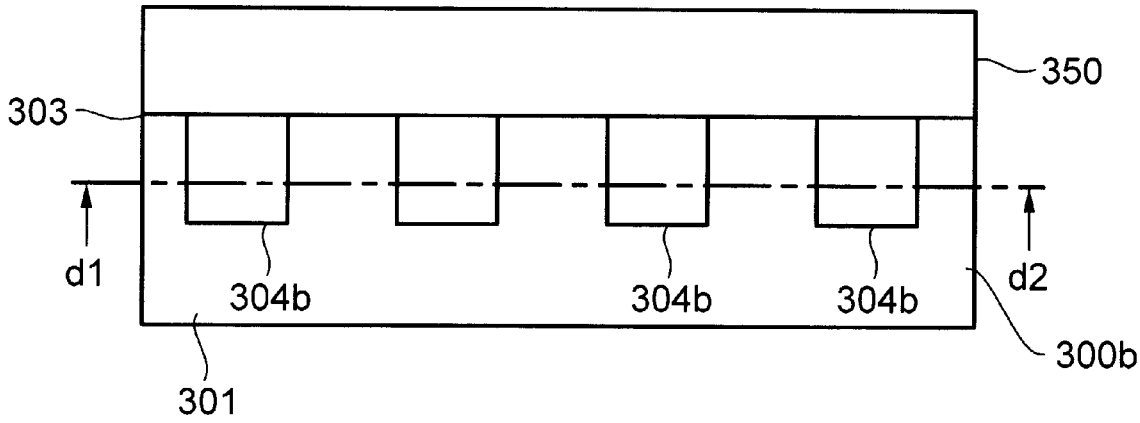
FIG. 7A is a front view showing an elastic blade 300*b* of another embodiment of the invention.

As shown in FIG. 7A, when depressed portions (recess) 304*b* having the same shape as the series of rectangular holes 304 in elastic blade 300 shown in FIG. 2 are provided instead, forming an elastic blade 300*b*, it has a reduced geometrical moment of inertia and it is possible to reduce the variational gradient of the linear load (free end abutment load) at the abutment portion in contact with the developing roller with respect to the displacement (deflection $\delta$) of free end 301 of elastic blade 300*b*. Therefore, this configuration offers the same effects as stated above.

Figure 7B:
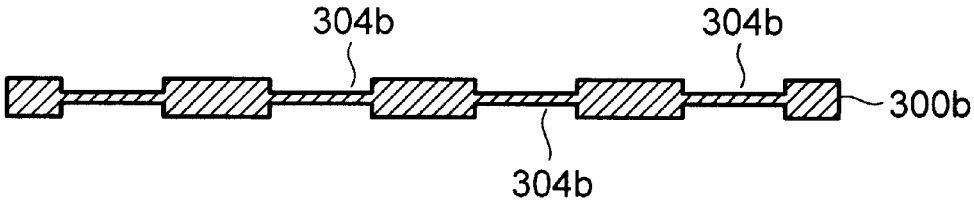
FIG. 7B is a sectional view taken along a line d1–d2 and FIG. 7C is another sectional view taken along a line d1–d2.
Figure 7C:
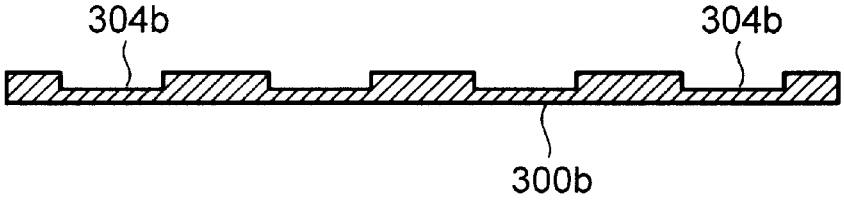

FIGS. 7B and 7C are views showing two examples of the sections taken along a line d1–d2 in FIG. 7A. FIG. 7B shows a configuration with depressed portions (recesses) 304*b* on both sides while FIG. 7C shows a configuration with depressed portions 304*b* on only the upper side. Here, the forming method of depressed portions 304*b* can be determined selectively. For example, though not illustrated, a configuration in which depressed portions 304*b* are provided on both the sides in an alternating manner so as form a cranked section can offer the same effects.

Preferred examples of the invention have been described in the above description of the embodiments, however the present invention should not be limited to these.

For example, though the above description has been made referring to a contact type developing unit using a non-magnetic mono-component developer, the present invention can also be applied to a unit for a magnetic developer or the like, as long as it forms a developer layer by using a flexible, plate-like developer layer regulating member (elastic blade). Also, it is clear that the present invention will work no matter if development is of a contact type or a non-contact type.

In the description of the above embodiments, the elastic blade has a cantilever structure with its free end residing on the upstream side with respect to the rotational direction of the developing roller as shown in FIG. 2. However, the present invention can also be applied to a configuration in which the blade has a cantilever structure with its free end residing on the downstream side with respect to the rotational direction of the developing roller.

The number of rectangular holes 304, holes (S1, S2 or S3), or depressed portions (recesses) 304*b* in the elastic blade is not particularly limited, but provision of a plural number of them as in the above embodiments is preferred.

For actual operation, a modified machine of a digital copier AR-5130, a product of Sharp Corporation, was used.

As has been described, according to the first aspect of the invention, it is possible to lessen the variational gradient of the linear load with respect to the displacement of the front end of the developer layer regulating member, leading to enlargement of the installation tolerance (the variation of P can be reduced by making I smaller). Further, since the characteristic frequency of the developer layer regulating member can be selected freely, it is possible to prevent a bad formation of the developer layer due to vibration (resonance) of the developer layer regulating member.

According to the second aspect of the invention, the linear load in the mid portion of the developer regulating member for forming a developer layer can be set up freely, independent of the sheet thickness and the free length of the developer layer regulating member. Therefore, it is possible to form a desired developer layer corresponding to the image area.

According to the third aspect of the invention, pressing failure at the sites extending to the free end from the areas of the void spaces in the developer layer regulating member can be prevented thus enabling stabilized developer layer formation.

According to the fourth aspect of the invention, since the linear load at both the end areas of the developer layer regulating member will not become too small, it is possible to avoid toner leakage from both end areas of the developer support.

According to the fifth and sixth aspects of the invention, it is possible to enhance the flexibility of the developer layer regulating member, which enables downsizing of the developing unit.

According to the seventh aspect of the invention, the flexibility of the developer layer regulating member can be enhanced by combinations of multiple series of through-holes of a simple shape such as a circle or combination of multiple series of recess, which enables downsizing of the developing unit as well as stabilized developer layer formation.

According to the eighth through tenth features of the invention, it is possible to eliminate the possibility of the void space exerting influence on the free end of the developer layer regulating member and hence it is possible to form a more stabilized developer layer.

According to the eleventh through fifteenth aspects of the invention, it is possible to prevent toner scattering through the through-holes formed on the developer layer regulating member without degrading the flexibility of the developer layer regulating member.

According to the sixteenth aspect of the invention, the perforation process for the developer layer regulating member can be simplified, which leads to provision of a low cost developer layer regulating member.

According to the seventeenth aspect of the invention, there is no need for a complex developing bias power source and hence it is possible to realize a compact inexpensive developing unit using, for example, a d.c. developing bias with no a.c. voltage superimposed.

According to the eighteenth aspect of the invention, it is possible to realize a compact developing unit capable of producing an excellent color image.

What is claimed is:

1. A developing unit comprising:

a developer support for retaining and conveying developer; and a flexible plate-like developer layer regulating member which is supported and fixed at one end and is free at an other end, the developer layer regulating member having a flat portion, in proximity to the free end, abutting against the developer support so as to form a developer layer of a designated thickness on the developer support, wherein void space made up of at least one through-hole is formed along a width in an area between the abutting flat portion of the developer layer regulating member and the fixed supported end said at least one through-hole being formed in an area closer to the fixed supported end of the developer layer regulating member, with respect to a midpoint between the free end and the fixed supported end of the developer layer regulating member, wherein a ratio (Lh/Lv) is set at 1 or lower, where Lh is a maximum dimension along a width of a void space formed in the developer layer regulating member and Lv is a maximum dimension in a direction perpendicular to the width of the void space.

2. The developing unit according to claim 1, wherein multiple series of void spaces are formed along a width of the developer layer regulating member.

3. The developing unit according to claim 1 wherein a sealing element having a higher flexibility than the developing layer regulating member is provided on at least one side in a through-hole formed area of the developer layer regulating member.

4. The developing unit according to claim 1, wherein the developer layer regulating member comprises a flexible metal plate.

5. The developing unit according to claim 1, wherein the developer support comprises a conductive elastic roller.

6. The developing unit according to claim 1, wherein the developer is a non-magnetic mono-component developer.

7. A developing unit comprising:

a developer support for retaining and conveying developer; and a flexible plate-like developer layer regulating member which is supported and fixed at one end and is free at an other end, the developer layer regulating member having a flat portion, in proximity to the free end, abutting against the developer support so as to form a developer layer of a designated thickness on the developer support, wherein a plurality of void spaces made up of through-holes are formed along a width in an area between the abutting flat portion of the developer layer regulating member and the fixed supported end, the plurality of void spaces being formed of a same void space shape at regular intervals on an area of the developer layer regulating member corresponding to at least a middle of a developer layer forming area on the developer support, a void space ratio (Lh/P) at both end areas of the developer regulating member being set smaller than a void space ratio of the developer regulating member corresponding to the middle of the developer layer forming area, wherein Lh is a maximum dimension along a void space and P is a pitch between adjacent void spaces.

8. The developing unit according to claim 7, wherein the void space ratio (Lh/P) of the developer layer regulating member corresponding to the middle of the developer layer forming area is set at 0.5 or lower.

9. The developing unit according to claim 7, wherein a ratio (Lh/Lv) of the developer regulating member corresponding to the middle of the developer layer forming area is set at 1 or lower, where Lh is the maximum dimension along a width of the void space and Lv is a maximum dimension in a direction perpendicular to the width of the void space.

10. The developing unit according to claim 7, wherein said at least one void space is formed in an area closer to the fixed supported end of the developer layer regulating member, with respect to a mid point between the free end and the fixed supported end of the developer layer regulating member.

11. The developing unit according to claim 7, wherein a sealing element having a higher flexibility than the developing layer regulating member is provided on at least one side in a through-hole formed area of the developer layer regulating member.

12. A developing unit comprising:

a developer support for retaining and conveying developer;

a flexible plate-like developer layer regulating member which is supported and fixed at one end and is free at an other end, the developer layer regulating member having a flat portion, in proximity to the free end, abutting against the developer support so as to form a developer layer of a designated thickness on the developer support, wherein void space made up of at least one through-hole is formed along a width in an area between the abutting flat portion of the developer layer regulating member and the fixed supported end; and a sealing element having a higher flexibility than the developer layer regulating member provided on at least one side in a through-hole formed area of the developer layer regulating member.

13. A developing unit comprising:

a developer support for retaining and conveying developer; and a flexible plate-like developer layer regulating member which is supported and fixed at one end and is free at an other end, the developer layer regulating member having a flat portion, in proximity to the free end, abutting against the developer support so as to form a developer layer of a designated thickness on the developer support, wherein void space made up of at least one recess is formed along a width in an area between the abutting flat portion of the developer layer regulating member and the fixed supported end, wherein a void space ratio (Lh/P) is set at 0.5 or lower, where Lh is a maximum dimension along a width of a void space formed in the developer layer regulating member and P is a pitch between adjacent void spaces.

14. The developing unit according to claim 13, wherein the void space is formed in an area closer to the fixed supported end of the developer layer regulating member, with respect to a mid point between the free end and the fixed supported end of the developer layer regulating member.

15. A developing unit comprising:

a developer support for retaining and conveying developer; and a flexible plate-like developer layer regulating member which is supported and fixed at one end and is free at an other end, the developer layer regulating member having a flat portion, in proximity to the free end, abutting against the developer support so as to form a developer layer of a designated thickness on the developer support, wherein a plurality of void spaces made up of recesses are formed along a width in an area between the abutting flat portion of the developer layer regulating member and the fixed supported end, the plurality of void spaces being formed of a same void space shape at regular intervals on an area of the developer layer regulating member corresponding to at least a middle of a developer layer forming area on the developer support, wherein a void space ratio (Lh/P) is set at 0.5 or lower, where Lh is a maximum dimension along a width of a void space formed in the developer layer regulating member and P is a pitch between adjacent void spaces.

16. The developing unit according to claim 15, wherein the void spaces are formed in an area closer to the fixed supported end of the developer layer regulating member, with respect to a mid point between the free end and the fixed supported end of the developer layer regulating member.

* * * * *